US006913570B2

(12) United States Patent
Kehrle

(10) Patent No.: US 6,913,570 B2
(45) Date of Patent: Jul. 5, 2005

(54) METHOD AND APPARATUS FOR PRODUCING A COMPOSITE STRUCTURAL PANEL WITH A FOLDED MATERIAL CORE

(75) Inventor: Rainer Kehrle, Stuttgart (DE)

(73) Assignee: Airbus Deutschland GmbH, Hamburg (DE)

( * ) Notice: Subject to any disclaimer, the term of this patent is extended or adjusted under 35 U.S.C. 154(b) by 0 days.

(21) Appl. No.: 10/713,638

(22) Filed: Nov. 13, 2003

(65) Prior Publication Data

US 2004/0102303 A1 May 27, 2004

(30) Foreign Application Priority Data

Nov. 14, 2002 (DE) ..... 102 52 941

(51) Int. Cl.[7] ..... B31F 1/00
(52) U.S. Cl. ..... 493/451; 493/463
(58) Field of Search ..... 493/451, 463, 493/955, 966

(56) References Cited

U.S. PATENT DOCUMENTS 3,959,056 A * 5/1976 Caplan ..... 156/197
4,012,932 A 3/1977 Gewiss
4,381,212 A * 4/1983 Roberts ..... 156/473
5,234,727 A 8/1993 Hoberman
5,419,796 A * 5/1995 Miller ..... 156/207
5,492,584 A * 2/1996 Bateman ..... 156/207
5,947,885 A 9/1999 Paterson
5,993,587 A * 11/1999 Seki et al. ..... 156/210
6,136,417 A * 10/2000 Ishibuchi et al. ..... 428/182
6,170,549 B1 * 1/2001 Marschke ..... 156/472
6,685,615 B2 * 2/2004 Weder ..... 493/463

* cited by examiner

*Primary Examiner*—Eugene Kim
(74) *Attorney, Agent, or Firm*—W. F. Fasse; W. G. Fasse

(57) ABSTRACT

A folded core structure is produced by embossing fold lines into a flat planar material web, initiating folds along the fold lines on the upper and lower surfaces of the material web, proceeding with the formation of the folds along the fold lines to deform the material web from its two-dimensional starting configuration to a three-dimensional folded configuration, and post-processing the folded material web to stabilize or fix the folded configuration thereof. A composite structural panel is produced by bonding a cover layer onto at least one surface of the folded core structure. An apparatus preferably includes embossing or creasing rolls to form the fold lines in the material web, air nozzles or folding rolls to initiate the folding process, bristle brush rolls to complete the folding process, and further folding rolls to enhance and fix the folded configuration, optionally in connection with heating, cooling, applying a coating onto, or impregnating a resin or binder into the material web.

28 Claims, 9 Drawing Sheets

METHOD AND APPARATUS FOR PRODUCING A COMPOSITE STRUCTURAL PANEL WITH A FOLDED MATERIAL CORE

PRIORITY CLAIM

This application is based on and claims the priority under 35 U.S.C. §119 of German Patent Application 102 52 941.8, filed on Nov. 14, 2002, the entire disclosure of which is incorporated herein by reference.

FIELD OF THE INVENTION

The invention relates to a method as well as an apparatus for producing a lightweight core structure from a web of a thin foldable starting material, and then covering the core structure with one or two cover layers to form a composite structural panel thereof.

BACKGROUND INFORMATION

It is generally known to form lightweight structural panels including a lightweight core structure sandwiched between two cover layers. The core structure typically is lightweight yet strong, because it has a configuration including hollow spaces as well as interconnected material webs or the like. Typical examples of such core structures include corrugated sheets, honeycomb cellular structures, and the like. Known core structures have a great variety of different configurations, and are made of a great variety of different materials.

The resulting composite structural panels, which respectively include such a core structure sandwiched and bonded between two cover layers, are used in many different applications, for example as lightweight structural panels or shell elements for walls, floors, and ceilings in transport aircraft, motor vehicles, ships, and trains. Such panels are similarly used in the interior and exterior construction of buildings. A further application of such composite structural panels is as filler panels or core panels of veneered furniture, for example, in the furniture manufacturing industry. Yet another application, especially in the case of corrugated cardboard panels, is the manufacture of crates, cartons, boxes and other packing materials from such composite structural panels.

Separately, it is known to form folded structures for various applications through the use of various different methods. These folding methods for folding sheet or web materials can be divided into intermittent or discontinuous processes, for example as described in U.S. Pat. No. 5,234,727, as well as continuous processes. Such continuous processes, in turn, can be divided into processes with a coupled or mutual lengthwise and crosswise contraction with a simultaneous expansion in the thickness direction of the starting material web (with a single-stage folding operation, for example as disclosed in U.S. Pat. No. 5,947,885), and processes in which the material web is first subjected to a crosswise contraction and is subsequently subjected to a deformation in the lengthwise direction of the material (in a two-stage folding operation, for example as disclosed in U.S. Pat. No. 4,012,932).

The continuous folding of long or essentially endless material webs necessarily involves an inexact deformation of the material in a mathematical and geometrical sense. Therefore, it is difficult, complicated, and costly to realize an actual mechanical apparatus that is to carry out the continuous folding of such a long material web in an exact manner, because a distortion or deformation of the material web arises, which may be within the deformation range of the elastic properties of the, material web and is difficult to control. In all of the above mentioned publications, the folding is carried out by a folding mechanism that accompanies the folding operation along the fold edges or the fold edges and surfaces.

SUMMARY OF THE INVENTION

In view of the above, it is an object of the invention to provide a method and an apparatus for producing a core structure of a composite structural panel, in which the starting material web is not stretched or compressed, and is also not provided with punched or cut-out openings, slits or cuts, yet is continuously folded with precise fold angles, precise fold lines, and precise resulting folded surfaces that are true to the intended and desired folded configuration. The invention further aims to avoid or overcome the disadvantages of the prior art, and to achieve additional advantages, as apparent from the present specification.

The above objects have been achieved according to the invention in a method of manufacturing a composite structural panel including a folded core structure bonded or otherwise attached to one or two cover layers. The starting material for manufacturing the core structure is a thin foldable material provided as a web, preferably of indefinite length, and may comprise a fiber material web, a fibrous semi-fabricated product, a pre-preg web (namely a fibrous semi-fabricated product web that is pre-impregnated with a curable resin or the like), a paper web, a cardboard web, a film web, a foil web, a metal sheet or the like. The flat web or sheet of the starting material is folded into a multi-surfaced, spatially three-dimensional, developable structure through the folding process, in which the starting material is subjected to a contraction in the width direction and the lengthwise direction as well as an expansion in the third spatial or thickness direction, relative to the dimensions of the starting material web.

More particularly, according to the inventive method, the material web provided in an initial flat planar un-folded condition is first subjected to a pre-processing step in which fold lines that allow a subsequent buckling or collapsing and precise folding of the material along these fold lines are formed in the material web. Particularly, this pre-processing or pre-treatment step is a continuous process in which plural curved or straight fold lines that meet or intersect each other in star-like repeating patterns, with respective surface areas bounded between the fold lines, are embossed, impressed, scored or creased into the material web from the upper surface and the lower surface thereof. Next, after the fold lines have been formed, the folding process is initiated along the fold lines from the upper surface and the lower surface of the material web. Then, the initiated folding process is progressively continued and completed to produce folds in the material web along the fold lines, whereby the material web is deformed and reconfigured from its two-dimensional initial configuration to a three-dimensional folded structure or configuration. After the folding process, the material web is further post-processed or post-treated in order to stabilize the achieved folded structure, e.g. by accentuating and/or fixing the folds.

According to further special aspects of the invention, the following additional features can be achieved. The fold lines or the resulting folded edges can exhibit a curved shape. The thin planar starting material can be further pre-treated by embossing, impressing, perforating, scoring, creasing, coating with a coating material, impregnating with a resin or other impregnating material, heating or cooling, along the fold lines or within the surface areas bounded by the fold lines while avoiding the fold lines. Also, the resulting folded core structure can be produced with a three-dimensional spatial configuration of which the folding pattern repeats itself.

According to the inventive method, it is possible to use flexible, limp or flaccid starting materials, such as woven webs for example, which inherently by themselves would not exhibit or develop any folding mechanism. Such materials can be made suitable for the present inventive folding process, for example by coating them with binders or by impregnating them with a synthetic resin, and further by pre-processing the fold lines, for example by partially scoring or perforating or creasing the woven web material along the intended fold lines, so that folded edges allowing a precise collapsing or buckling of the material along the fold lines will be formed.

Furthermore, with the inventive step of initiating the folding; process along the fold lines formed in the pre-treatment step, the pre-treated material itself serves to provide or develop the folding mechanism, due to the pre-treatment and pre-forming of the fold lines, without requiring any folding template such as a master fold sheet or the like and without requiring a folding guide. In fact, the initiation of the folding process can be carried out without even contacting the pre-treated web, for example by means of air jets directed at appropriate locations on the upper surface and the lower surface of the pre-treated material web.

Still further according to the invention, the folding process that is carried out after the initiation of the folds along the pre-formed fold lines serves to deform and reconfigure the thin two-dimensional starting material into a three-dimensional folded configuration with folded edges that are folded precisely at prescribed angles or extend along prescribed curves so as to result in the final three-dimensional folded configuration having accurate desired fold angles and accurate desired surfaces bounded between the folded edges. Thereby, in the folding process, the core structure undergoes both a length variation as well as a width variation relative to the two-dimensional initial configuration of the material web. This folding process is carried out as a continuous through-flow process in which the starting material is continuously fed into the folding apparatus carrying out the folding process, and the resulting folded core structure can be continuously removed therefrom.

The core structures produced according to the inventive method are characterized advantageously by a low density and simultaneously by a high bending stiffness and compressive stiffness as well as a high strength, especially in combination with the cover layers arranged and bonded thereon to form the complete structural panel. Due to the particular selected starting material, a good noise insulation characteristic can also be achieved, which can be further improved by perforation of the cover layers. A further advantage of the invention is a significant cost reduction achieved by the substantial increase in the production speed, which is achieved in the continuous fabrication using the method and apparatus of the invention.

The possibility of folding the starting materials also along curved folded edges rather than or in addition to straight folded edges greatly improves the compressive stiffness and strength and therewith substantially expands the field of application of these core structures, because structures that are folded along curved folded edges are bendable or curvable overall, as opposed to structures that are only folded along straight folded edges. When such a curved or non-planar folded core structure is bonded to curved non-planar cover layers, the curved folded edges of the core structure will lie in contact with the respective upper and lower cover layer along the entire length of the folded edge, and thus may be advantageously glued or otherwise bonded to the respective cover layer along this entire folded edge. This achieves an especially good bonding connection between the core and the cover layers.

The above objects have further been achieved according to the invention in an apparatus for forming a composite structural panel, and particularly for carrying out the inventive method. The inventive apparatus includes a device or arrangement for pre-treating or pre-processing the starting material web on the upper surface and the lower surface thereof in order to form therein fold lines that will allow a collapsing or buckling of the material web along these fold lines. The apparatus further includes a device or arrangement for initiating the folding process along the previously formed fold lines. The apparatus also includes a device or arrangement for carrying out the additional deformation, reconfiguration, and/or retardation of the material web to further carry out the folding process along the previously initiated folds on the fold lines, with at least one pair of counter-rotating bristle brush rolls or bristle brush conveyor belts. The apparatus still further includes a device or arrangement for post-processing or post-treating the material web from the upper surface and the lower surface thereof in order to stabilize the folded structure by enhancing and/or fixing the folds for example.

According to a further development of the apparatus according to the invention, at least one counter-rotating pair of rolls, a pair of conveyor belts, or a pair of link chains or belts is provided for carrying out the pre-processing or pre-treatment of the planar starting material web. In this context, at least one of the two rolls, conveyor belts, or link chains or belts has a structured surface, which cooperates with a smooth non-structured surface of the opposite or complementary element to form the fold-lines in the planar starting material web. Throughout this disclosure, the term "structured surface" refers to a surface that is not smooth, but rather includes profiled protrusions such as ridges or the like, at locations in a pattern corresponding to the pattern of fold lines to be formed in the material web. Thus, the respective roll, conveyor belt, or link chain can be provided with protruding ridges, creasing blades, scoring blades, perforating blades or the like, which cooperate with the smooth surface of the counter-roll or other counter element. The smooth surface of the counter element may have an elastic resilient surface covering, to allow the protruding ridges or the like of the structured surface of the other element to press into this resilient surface covering in order to form the fold lines on the material web. Alternatively, the counter-element may have a surface provided with recesses corresponding to and cooperating with the protruding ridges or the like of the opposite roll or other element. In addition to or instead of the just-described elements with a structured surface, the pre-treating arrangement can additionally or alternatively include a device for heating or cooling certain zones of the material web, and/or a device for coating or impregnating the material web.

According to the invention, the device or arrangement for initiating the folding process along the previously formed fold lines can comprise at least one row of fluid nozzles, preferably compressed air nozzles, which are arranged to be movable relative to the material web. Respective groups or arrays of such nozzles are arranged above and below the material web and are oriented opposite one another so as to direct jets of fluid, e.g. compressed air, onto the upper surface and the lower surface of the material web, e.g along the fold lines and/or at appropriate surface areas for initiating folds along the fold lines. Thereby, the air jets from below the material web push up and initiate the formation of fold peaks in the material web, while the air jets above the material web push down along corresponding fold lines to initiate the formation of fold valleys in the material web.

A further embodiment of the device or arrangement for initiating the folding process according to the invention comprises a mechanical arrangement that physically contacts and touches the material web either in a point-wise manner or along individual fold lines, both from the upper surface and the lower surface of the material web, so as to begin the folding process. In such a mechanical device, mechanical fingers or protrusions or disk elements take the place of the air jets discussed above in the fluid nozzle arrangement for initiating the folding process.

The device or arrangement for initiating the folding process according to the invention can alternatively or additionally comprise a contraction and expansion device that simultaneously carries out a crosswise or transverse contraction and a vertical or thickness-directed expansion of the material web along the fold lines, but does not yet cause a longitudinal contraction of the material web. This device comprises at least one pair of counter-rotating rolls, or at least one arrangement with a comb-like gap in which the material web is caused to contract in the crosswise or transverse direction perpendicular to its longitudinal extension, and to expand in the vertical thickness direction. During that process, a compensation of the running length respectively of the center of the material web and of the edges of the material web is carried out by a suitable targeted deflection of the material web in its middle or center area relative to its edges. After the crosswise or transverse contraction of the material web (in connection with forming the folds along longitudinally extending fold lines), an alternating perpendicular displacement of the web is carried out by means of an apparatus operating with compressed air or by means of a suitable mechanical arrangement, so as to form the peaks and valleys along the transversely extending fold lines, which thereby causes a longitudinal contraction of the material web.

A further varied embodiment of an apparatus for deformation, reconfiguration, and/or retardation (e.g. longitudinal contraction) of the material web according to the invention comprises compressed air nozzles that blow against the upper surface and the lower surface of the folded material web in a direction contrary to the forward production travel direction. This achieves or supports a contraction of the material web with respect to the longitudinal production travel direction, which is involved in the folding operation of forming the peaks and valleys especially along transversely extending fold lines.

An example embodiment of the device or arrangement for post-treating or post-processing the folded material web comprises at least one pair of counter-rotating rolls, conveyor belts, or link chain or belt mechanisms, having a structured surface of which the developed (e.g. circumferential) projection corresponds to the folded structure of the folded material web. Alternatively, the structured surface of the post-processing elements contacts the folded material web at least along the folded edges thereof, so as to reinforce and stabilize the folded configuration of the material web. Furthermore, the post-treatment arrangement may include an apparatus for coating, impregnating, heating, or cooling the material web, so as to further stabilize or permanently fix the folded configuration of the folded material web.

Furthermore, the inventive apparatus preferably includes a post-treating or post-processing device for applying at least one material web as a layer, e.g. the cover layer, onto at least one surface of the folded core structure. The material used for the cover layer(s) in this regard may be any conventionally known cover layer material of a lightweight structural panel. Moreover, the post-treating apparatus can include a cutting device and a transport device for carrying away finished cut segments of the folded core structure or the finished composite structural panel.

BRIEF DESCRIPTION OF THE DRAWINGS

In order that the invention may be clearly understood, it will now be described in connection with example embodiments thereof, with reference to the accompanying drawings, wherein.

DETAILED DESCRIPTION OF A PREFERRED EXAMPLE EMBODIMENT AND OF THE BEST MODE OF THE INVENTION

Figure 1:
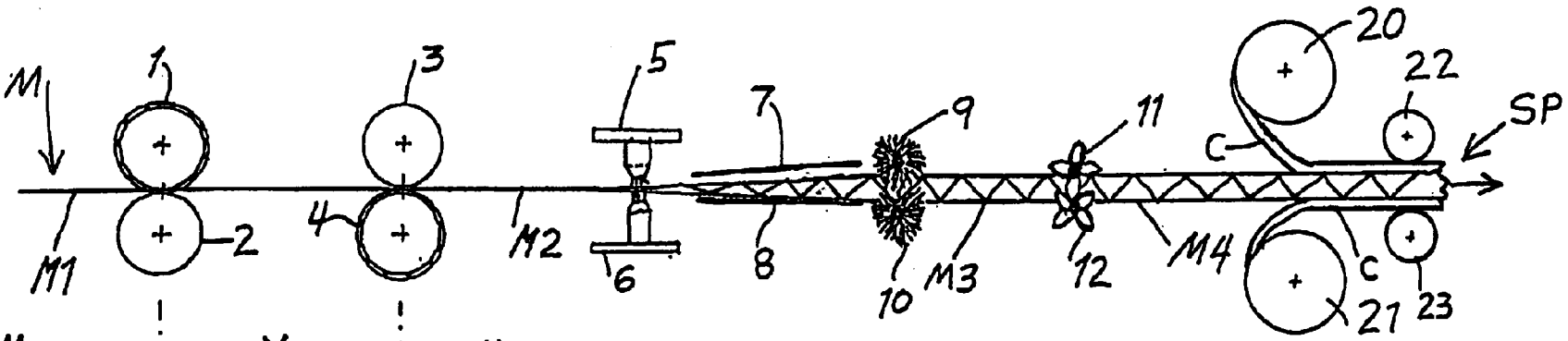
FIG. 1 is a schematic side view of a first embodiment of an apparatus for manufacturing a composite structural panel including a folded core structure according to the invention.
Figure 2:
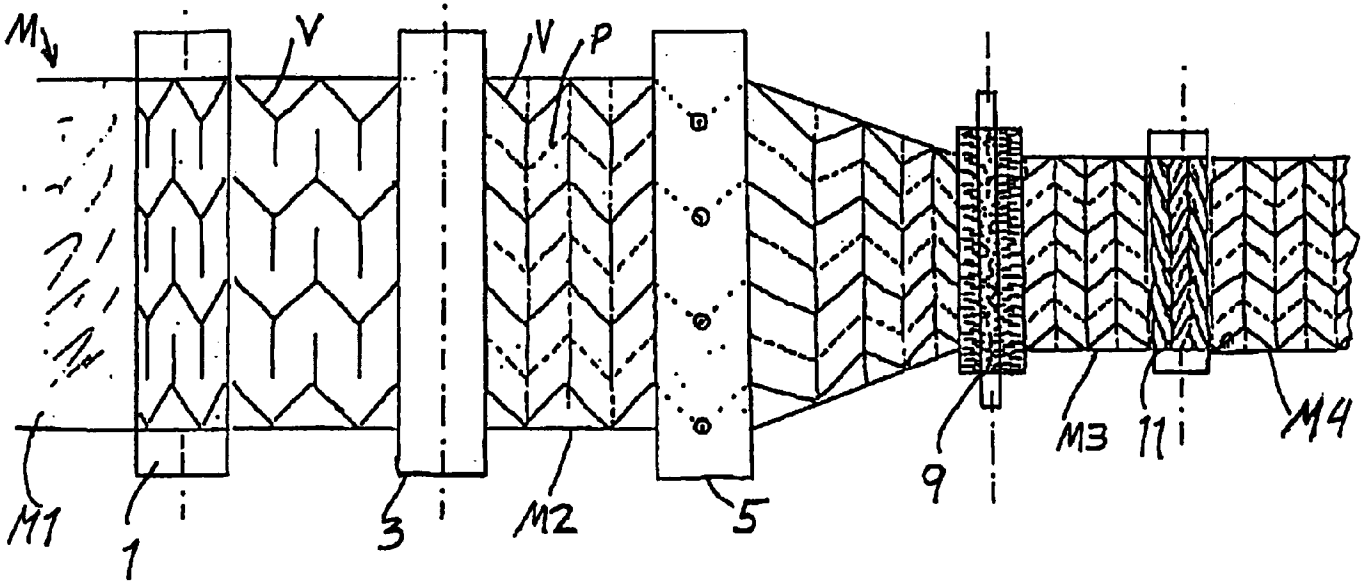
FIG. 2 is a schematic top plan view of the apparatus according to FIG. 1.

FIGS. 1 and 2 schematically show a first embodiment of an apparatus according to the invention for carrying out the method according to the invention. Namely, the apparatus shown in FIGS. 1 and 2 is for producing a composite structural panel SP including a core structure sandwiched and bonded between two cover layers C. The core structure is produced by folding a material web M, for example of paper or cardboard or resin-impregnated fiber. In the present embodiment, the folding process is a single stage folding process involving a transverse contraction, a longitudinal contraction, and a thickness expansion of the material web M occurring simultaneously. In this folding process, first, fold lines are formed in the initially flat planar configuration M1 of the material web M, and then fold valleys V, shown by solid lines, and fold peaks P, shown by dashed lines, are formed in the material web along the respective associated fold lines.

More particularly, the apparatus includes a first structured roll 1 with a structured surface, e.g. a surface with protruding ridges or creasing blades or the like, as well as a first counter roll 2 which is preferably a smooth roll with a smooth surface, such as a smooth elastically yielding surface. The material web M with its initial flat planar configuration M1 passes through the nip between the first pair of rolls 1 and 2, whereby the protrusions or creasing blades of the structured surface of the structured roll 1 press against the smooth surface of the smooth roll 2 with the material web M therebetween. Thereby the creasing blades or the like form valley fold lines V in the upper surface of the material web M. In this context, the repetitive pattern of the protrusions or creasing blades on the structured surface of the structured roll 1 forms the corresponding developed pattern of the valley fold lines V on the material web M.

Next, the still-planar material web M proceeds to a second roll pair including a second smooth counter roll 3 cooperating with a second structured roll 4. These rolls 3 and 4 operate similarly as the rolls 2 and 1, respectively. Namely, as the material web M passes through the nip between the two rolls 3 and 4, the protrusions or creasing blades of the structured roll 4 emboss or press peak fold lines P into the material web M from the bottom surface thereof. Thus, upon exiting the second pair of rolls 3 and 4, the material web M now has a still-planar configuration M2, but with peak fold lines P and valley fold lines V embossed, pressed, creased or scored in the material thereof.

Next, the material web is advanced in the forward travel direction to a pair of movable air nozzle arrangements 5 and 6, which are respectively arranged above and below the material web M, and which each respectively include plural compressed air jet nozzles. The air jet nozzles are located appropriately, and can be either continuously or intermittently supplied with compressed air, so as to direct compressed air jets at suitable locations, e.g. along the respective fold lines P and V, so as to push the peak fold lines P upwardly and push the valley fold lines V downwardly relative to the initial flat plane of the material web. In this manner, the air jets directed from the air nozzle arrangements 5 and 6 initiate the folding process, i.e. initiate the formation of folds in the proper directions about the embossed fold lines P and V.

Next, the material web M with the initiated folds proceeds from the air nozzle arrangements 5 and 6 to a pair of bristle brush rolls 9 and 10 arranged respectively above and below the material web M. Thereby, the folds along the fold lines in the material web M that were initiated by the air nozzle arrangements 5 and 6 are now further developed and folded by the mechanical pressing contact exerted by the intermeshing bristles of the brush rolls 9 and 10 in a somewhat flexible and yielding manner. Thereby, as the folds in both longitudinal and transverse directions (and/or diagonal directions) in the material web are developed, the web undergoes a contraction in both the longitudinal travel direction and in the transverse width direction, while simultaneously undergoing an expansion in the vertical height or thickness direction.

As can be seen in FIG. 1, the thickness of the material web increases as the folding process progresses from the initiation at the air nozzle arrangements 5 and 6 to the completion thereof at the brush rolls 9 and 10. Simultaneously, as can be seen in FIG. 2, the transverse width of the material web contracts as the folding process progresses between the air nozzle arrangements 5 and 6 and the brush rolls 9 and 10. Also, the brush rolls 9 and 10 retard or decelerate the forward travel of the material web to accommodate or even to cause the longitudinal contraction of the material web as the folding process progresses. The material web M then exits from the brush rolls 9 and 10 with the finished folded configuration M3.

As the folding process progresses between the air nozzle arrangements 5 and 6 and the brush rolls 9 and 10, the material web M and the progress of the folding thereof can be constrained and guided through an expansion/contraction guide arrangement 7 and 8 shown schematically in FIG. 1. This guide arrangement 7 and 8 may comprise simple plates 7 and 8 arranged above and below the material web M with an expanding vertical distance therebetween. Such plates 7 and 8 simply constrain and guide the vertical thickness expansion without guiding or causing the transverse contraction due to folding along longitudinally extending fold lines. Thus, with such plates 7 and 8, a single-stage compound folding as described above progresses between the air nozzles arrangements 5 and 6 and the brush rolls 9 and 10. Alternatively (as will be described further below), the guides 7 and 8 may be replaced with plates having guide channels that taper relative to each other in the transverse width direction as the height or vertical gap spacing increases, so as to guide and develop the transverse folding of the longitudinally extending fold peaks and fold valleys as they are progressively formed in the transition from the air nozzle arrangements 5 and 6 to the brush rolls 9 and 10.

After exiting from the brush rolls 9 and 10, the material web M with the folded configuration M3 is then transported between the intermeshing or interengaging nip of two special after-treatment or post-processing rolls 11 and 12 so as to stabilize and fix the folded configuration M3 and thus form a stabilized or fixed folded configuration M4. In this embodiment, the rolls 11 and 12 are fold stabilizing rolls that respectively have interengaging structured surfaces with a developed contour pattern corresponding to the fold pattern. Thereby these rolls can further emboss and thus sharpen or emphasize the folded edges of the folded structure. These rolls 11 and 12 may additionally be heated or cooled or further combined with a resin coating device or resin impregnating device so as to contribute to the resin-fixing of the folded configuration M3 of the material web M to thereby form the fixed or stabilized configuration M4 of the folded core structure.

At this stage, the completed, folded, fixed material web forming the core structure M4 can be continuously withdrawn from the folding process, and can be further cut into separate core panels (e.g. by any known cutting device) and transported (e.g. by any known transport device such as a conveyor) or stored as such for later use. Alternatively, the continuous core structure exiting the folding process, or individual cut core panels thereof, can be directed into a further process for bonding at least one cover layer C onto at least the upper surface or the lower surface of the core structure. This is schematically indicated in FIG. 1, where two cover layers C are provided from rolls 20 and 21, and are then laminated and bonded onto the core structure by laminating rolls 22 and 23. This can be achieved by heat-lamination or with an additional adhesive if necessary, or in any conventionally known manner of applying and bonding a cover layer onto a core structure to form a composite structural panel SP thereof. The laminated structural panel SP can be continuously or piece-wise removed from the output end of the process.

Figure 3:
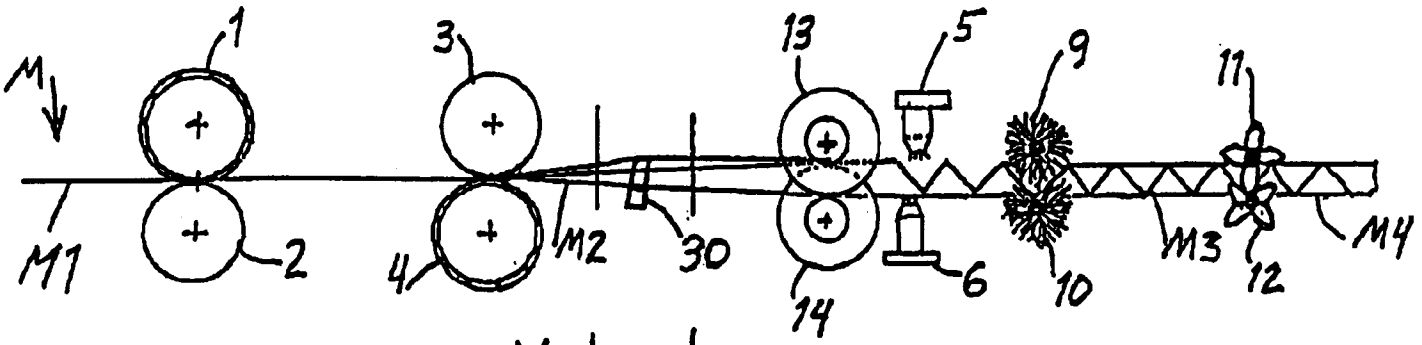
FIG. 3 is a schematic side view generally corresponding to FIG. 1, but showing a second embodiment of an apparatus according to the invention.
Figure 4:
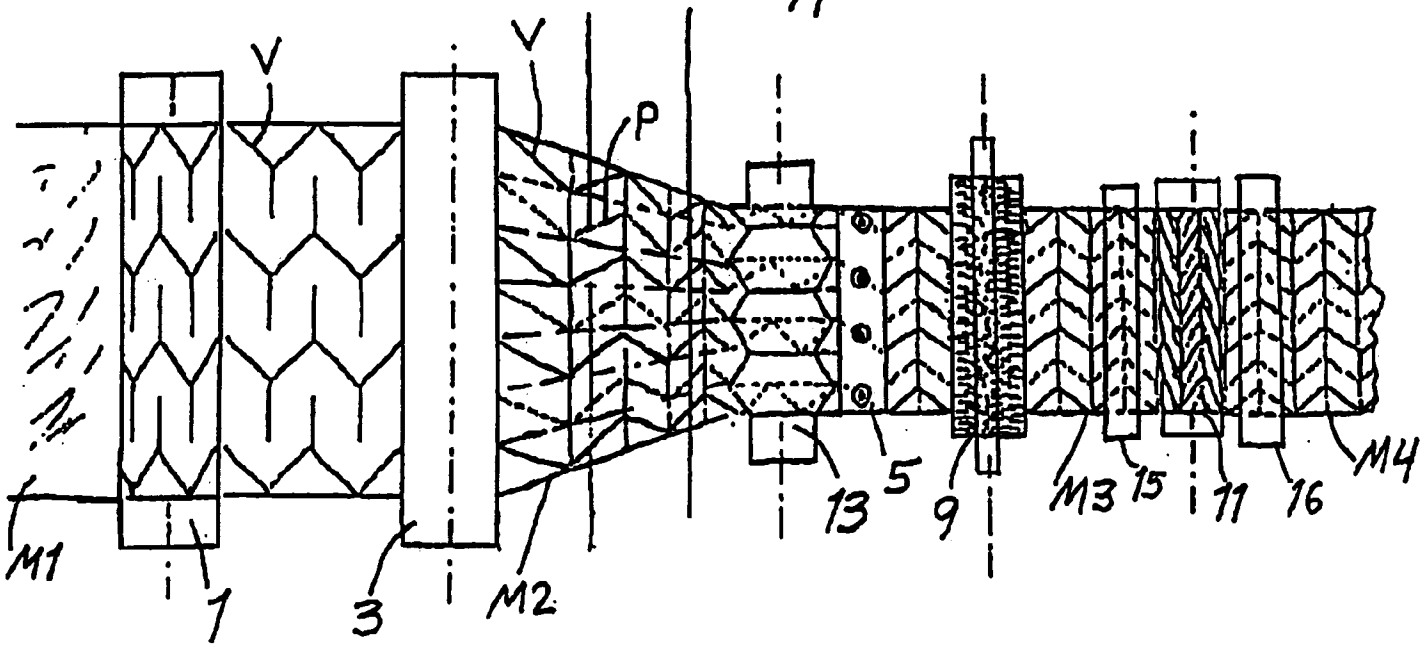
FIG. 4 is a schematic top plan view of the apparatus according to FIG. 3.

FIGS. 3 and 4 show a second embodiment of an apparatus and method for forming a folded core structure (which can then further be used to form a composite structural panel as described above). The apparatus and process of FIGS. 3 and 4 have much overlap and correspondence with those of FIGS. 1 and 2, and a redundant description of the corresponding components and process steps will be omitted. The same reference numbers are used to identify corresponding features in the embodiment of FIGS. 3 and 4 as in the embodiment of FIGS. 1 and 2.

The main difference between the first embodiment of FIGS. 1 and 2 and the second embodiment of FIGS. 3 and 4 is that the first embodiment involves a single-stage total compound folding process, while the second embodiment involves a two-stage folding process with a transverse contraction and thickness expansion in a first stage followed by a longitudinal contraction in a second stage. In this regard, the apparatus of FIGS. 3 and 4 comprises an additional of a pair of transverse contraction rolls 13 and 14 between the second pair of fold line creasing rolls 3 and 4 and the pair of air nozzle arrangements 5 and 6, and particularly at a location proximate to and just upstream of the air nozzle arrangements 5 and 6. This pair of rolls 13 and 14 includes relatively deeply intermeshing or interengaging circumferential V-profile discs or roll segments which cause the material web M to be at least partially folded in a corrugated or zig-zag folded fashion in the transverse width direction (i.e. along longitudinally extending folded edges), while undergoing a corresponding transverse width-wise contraction. Namely, this pair of rolls 13 and 14 already carries out the folding and contraction of the material web M in the transverse or width direction along longitudinally extending fold lines, before the web even reaches the air nozzle arrangements 5 and 6, which then initiate the folding of the web along transversely extending fold lines. This initiated folding is further carried out and completed by the brush rolls 9 and 10, while the web travel is also decelerated or retarded in the travel direction in connection with the longitudinal contraction of the web, in a similar manner as described above in connection with FIGS. 1 and 2.

While carrying out the transverse or width-wise contraction of the material web M, a compensation of the forward linear travel distance of the web must be carried out, because otherwise a portion of the material web M along the longitudinal center line thereof would have to travel a shorter distance than portions of the web along the outer edges thereof, as is apparent in the top plan view of FIG. 4. In order to compensate for this difference, the material web preferably passes over a skimming or gliding support in the shape of an arch or curve as seen on a plane perpendicular to the longitudinal travel direction of the material web. Thus, by passing over this support as schematically shown at 30 in FIG. 3, the central portion of the material web M is caused to bulge upwardly relative to the edge portions of the material web, or alternatively the central portion is allowed to sag downwardly relative to the edge portions, so that the travel distance between the roll pair 3 and 4 and the roll pair 13 and 14 is the same for all portions of the material web, despite the transverse or width-wise contraction of the material web.

The further processing of the web downstream from the brush rolls 9 and 10 may be the same as discussed above in connection with FIGS. 1 and 2. Additionally, as may also be provided in the apparatus of FIGS. 1 and 2, FIG. 4 schematically shows optional further post-treating devices 15 and 16, which, for example, carry out heating, cooling, resin-impregnation, and/or binder-coating of the material web, upstream and/or downstream of the fold-stabilizing rolls 11 and 12. Thereby, these devices 15 and/or 16 contribute to the stabilizing and fixing of the folded structure M3 to form the stabilized folded structure M4 of the folded core structure.

Figure 5:
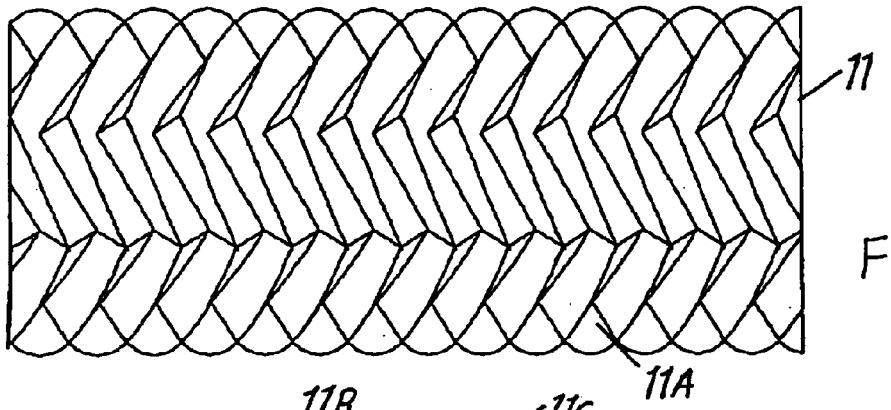
FIG. 5 is a schematic side view of a single folding roll.
Figure 6:
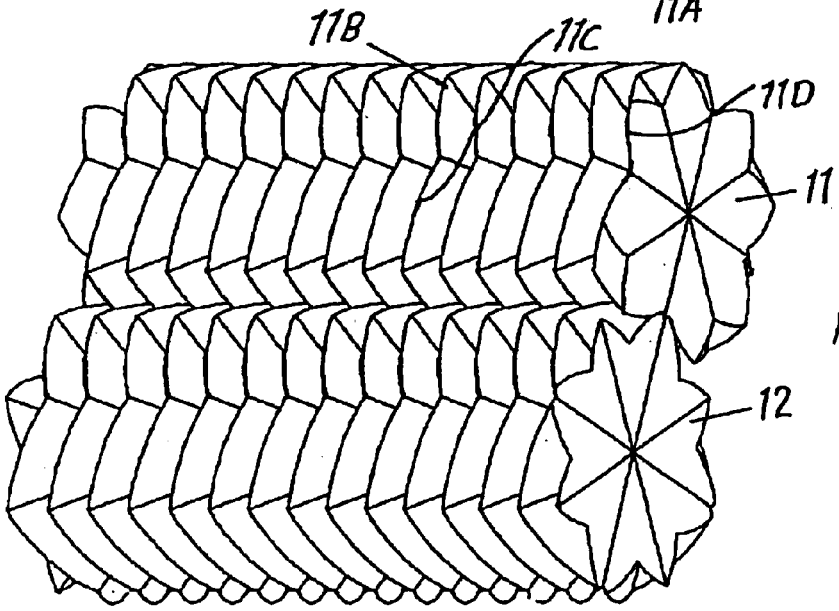
FIG. 6 is a schematic perspective view of a pair of folding rolls.

FIG. 5 shows a single folding roll or fold-stabilizing 11 that comprises a structured surface 11A on its outer circumference. In FIG. 6, a pair of two of such folding rolls 11 and 12 is shown in the operational intermeshed or interengaged condition, whereby the two rolls 11 and 12 are counter-rotating, with the material web passing through the intermeshing nip therebetween. The rolls 11 and 12 each comprise an even number (in this case four) of segments with alternating right-hand and left-hand (or clockwise and counterclockwise) helical configurations 11B and 11C about the circumference. Namely, the respective segments are formed substantially as alternating segments of clockwise and counterclockwise helical threadings that intersect each other. The pattern of these segments 11B and 11C, in a circumferential development thereof, corresponds to the pattern of fold lines to be formed on the material web as described above. In order to finish and stabilize, or to initiate the folding process of zig-zag folded structures with particular characteristics, the respective rolls may comprise an involute surface 11D, namely having a circumferential contour based on an involute at each section plane perpendicular to the roll axis. Further in this context, each roll is divided into an even number of such segments. A coupling of the counter-rotation of the folding rolls 11 and 12 can be carried out mechanically by means of toothed gears, or chains on sprocket wheels, or through electronic regulation.

Figure 7:
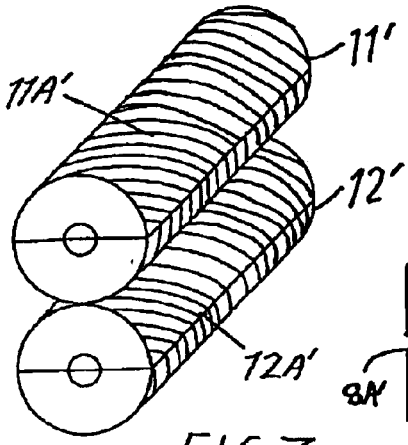
FIG. 7 is a schematic view of a further embodiment of a pair of folding rolls.

FIG. 7 schematically shows an alternative embodiment of a pair of folding rolls 11' and 12' according to a varied embodiment, with an even number (in this case two) of segments 11A' and 12A' with alternating right-hand and left-hand or clockwise and counterclockwise threading slopes. In this case also, the pair of rolls 11' and 12' can be coupled to each other mechanically by toothed gear wheels or by chains on sprocket wheels, or by electronic regulation.

Figure 8:
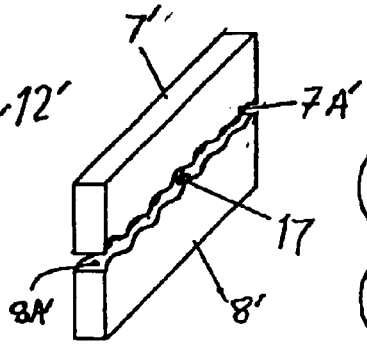
FIG. 8 is a schematic perspective view of a comb-like arrangement for carrying out or guiding a crosswise contraction and thickness expansion of the material web.

FIG. 8 schematically represents a device for supporting and guiding the transverse or width-wise contraction and vertical expansion of the material web during the folding process, including two comb-like expansion/contraction guides 7' and 8' with an adjustable gap 17 therebetween. This arrangement represents an alternative of the expansion/contraction guides 7 and 8 discussed above and shown schematically in FIG. 1. This embodiment of the guides 7' and 8' is especially for a two-stage folding process, for example as takes place in FIGS. 3 and 4 using the expansion/contraction rolls 13 and 14 to carry out a transverse or width-wise contraction and folding separately from and before the longitudinal contraction and folding. As the material web is folded along longitudinally extending fold lines in at least one folding stage, the material web passes through the adjustable gap 17 between the opposite end faces 7A' and 8A' of the opposite plate-shaped guide members 7' and 8'. These opposed end faces 7A' and 8A' are respectively provided with corresponding wavy or corrugated structures, which receive and guide the longitudinally extending folded peak edges and folded valley edges of the material web, as the folding process progresses. The pattern of the corrugation of the opposite faces 7A' and 8A' is thus selected to correspond to the pattern, configuration, and dimensions of the partially-formed fold peaks and fold valleys at the respective selected position along the transport direction in the folding apparatus, i.e. along the folding process.

Figure 9:
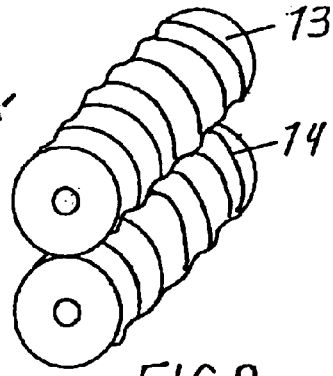
FIG. 9 is a schematic perspective view of an alternative arrangement using a roll pair for carrying out the crosswise contraction and thickness expansion of the material web.

FIG. 9 shows a further possible arrangement for supporting or carrying out the transverse width-wise contraction and folding of the material web along longitudinally extending fold lines, for example a particular embodiment of the expansion/contraction rolls 13, 14 shown in FIGS. 3 and 4. This arrangement essentially comprises two counter-rotating folding rolls 13 and 14 of which the circumferential surfaces are suitably corrugated in a pattern matching the transverse or width-wise folding of the material web. Thus, as the material web passes between these two intermeshing rolls 13 and 14, the material web undergoes a contraction in the transverse or width-wise direction perpendicular to the forward travel direction, and simultaneously an expansion in the vertical thickness direction.

The schematic diagram of a general folding pattern shown in FIG. 10 serves as a general reference for the explanation of the subsequently described specific folding patterns, especially with respect to various dimensions thereof. These folding patterns are developed in a continuous folding process according to the invention as described above. Particularly, these are possible folding patterns of the folded core structure of the composite structural panel according to the invention. In these schematic diagrams of the folding patterns, a dashed line indicates a fold peak P while a solid line indicates a fold valley V. In this regard, a fold peak indicates a fold angle of >180° about the fold line as measured on the upper surface of the folded material web, while a fold valley indicates a fold angle of <180° about the fold line as measured on the upper surface of the folded material web. Furthermore, dotted lines represent construction auxiliary lines with no fold, i.e. a "fold" angle=180°.

Figure 10:
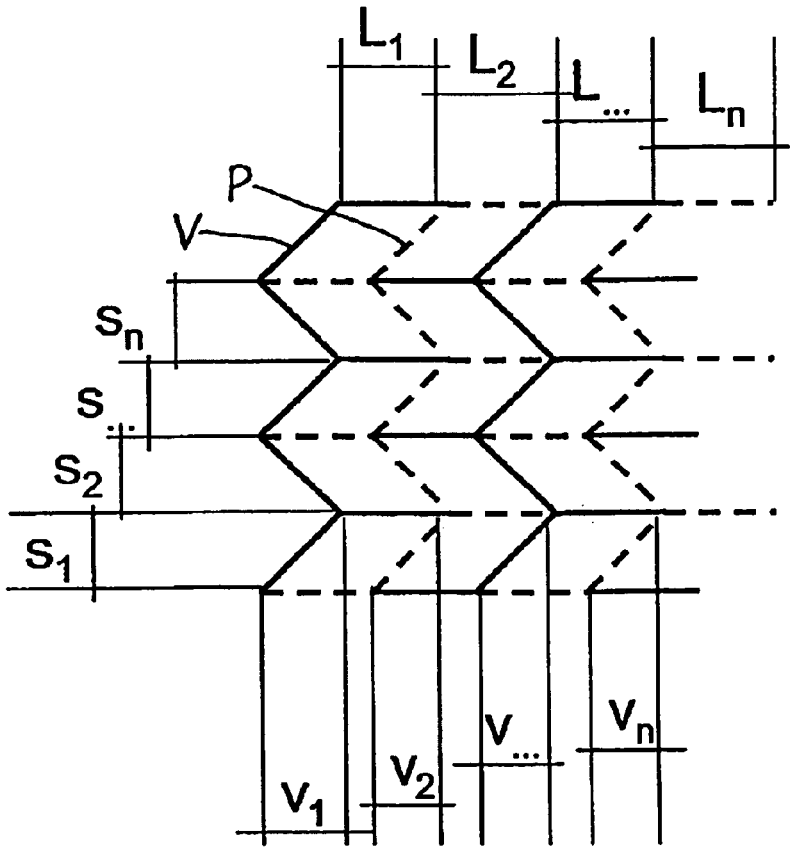
FIG. 10 is a schematic diagram of a fold structure for reference and for explanation of different embodiments of fold structures that are respectively illustrated in FIGS. 11 to 21.

FIG. 10 further illustrates the longitudinal dimension or length $L_1$, $L_2$, $L_{\ldots}$, $L_n$ measured in the longitudinal direction of the material web from one transversely extending fold line to the next, e.g. from a fold peak P to the next fold valley V in the longitudinal direction. Reference $S_1$, $S_2$, $S_{\ldots}$, $S_n$ identifies the transverse spacing in the width direction of the material web, between respective adjacent longitudinally extending fold lines, e.g. between a fold peak P and the laterally or transversely adjacent fold valley V. The vertical height of the folded protrusion from the lowermost to the uppermost portion of a given fold line, e.g. along a fold peak P or along a fold valley V is respectively identified by $V_1$, $V_2$, $V_{\ldots}$, $V_n$. As will be discussed next in connection with specific examples as shown in the following figures, each one of these respective dimensions can be the same or different in successive segments of the repeating fold pattern.

Figure 11:
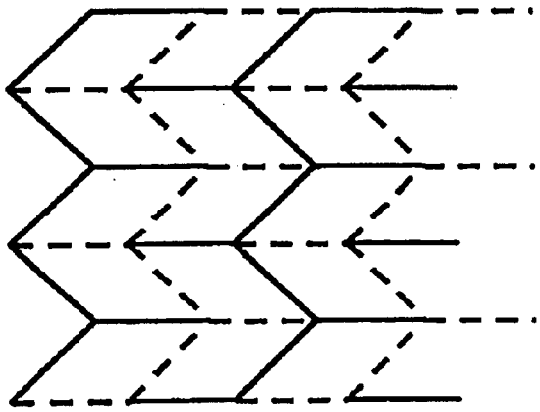
FIGS. 11 to 21 are schematic diagrams of respective different fold structures having different fold patterns.

FIG. 11 shows a simple zig-zag fold pattern with the characteristic that $V_1=V_2=V_{\ldots}=V_n$, and $S_1=S_2=S_{\ldots}=S_n$, and $L_1=L_2=L_{\ldots}=L_n$.

Figure 12:
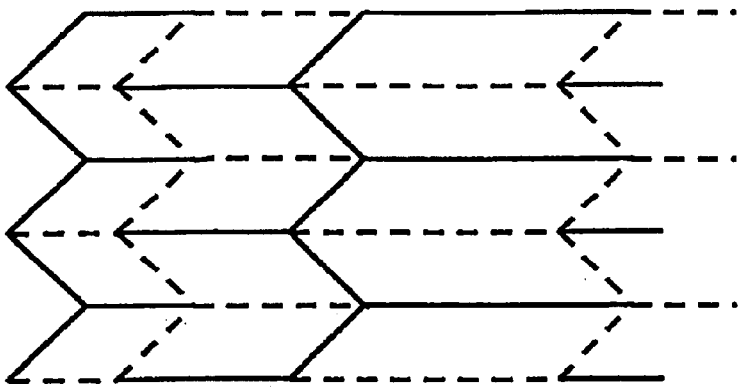

FIG. 12 shows a zig-fold pattern in which the vertical height and the lateral spacing of each adjacent pattern segment remains the same, namely $V_1=V_2=V_{\ldots}=V_n$, and $S_1=S_2=S_{\ldots}=S_n$, but the longitudinal length of successive segments of the patterns varies, namely $L_1\neq L_2\neq L_{\ldots}\neq L_n$.

Figure 13:
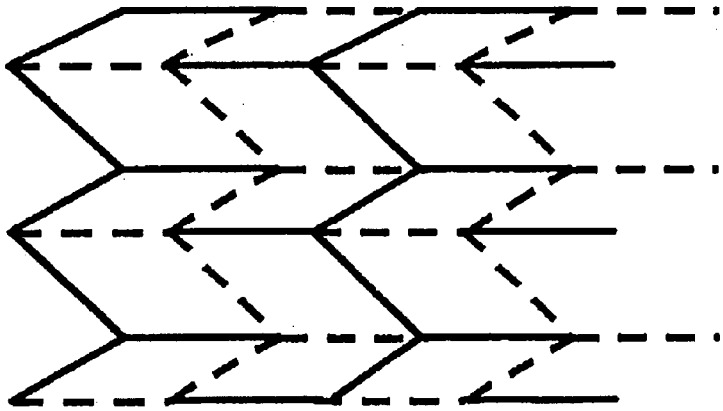

FIG. 13 shows a further more-complex variant of a zig-zag fold pattern in which only the vertical height remains consistent, while the lateral spacing and the longitudinal length vary. Namely, in this fold pattern $V_1=V_2=V_{\ldots}=V_n$, while $S_1\neq S_2\neq S_{\ldots}\neq S_n$, and $L_1\neq L_2\neq L_{\ldots}\neq L_n$.

Figure 14:
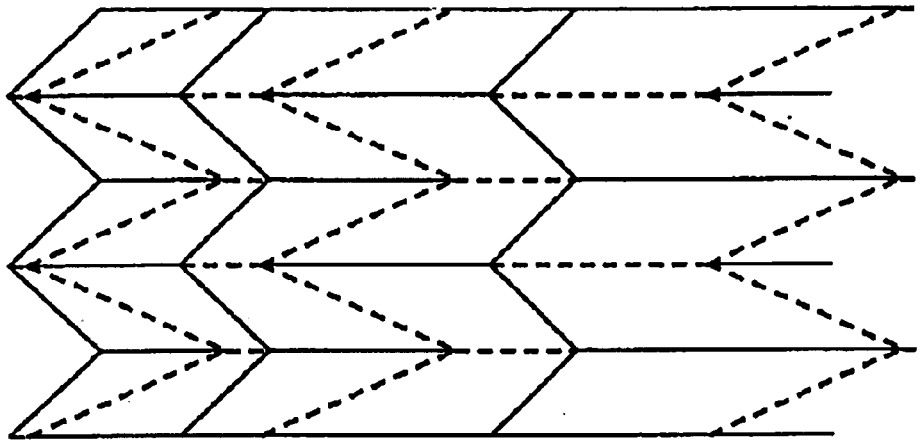

FIG. 14 illustrates another complex zig-zag fold pattern of which the transverse width or spacing between the longitudinal fold lines remains consistent, i.e. $S_1=S_2=S_{\ldots}=S_n$, but the vertical height of the folds varies and the longitudinal length or spacing between successive transverse fold lines varies, i.e. $V_1\neq V_2\neq V_{\ldots}\neq V_n$, and $L_1\neq L_2\neq L_{\ldots}\neq L_n$.

Figure 15:
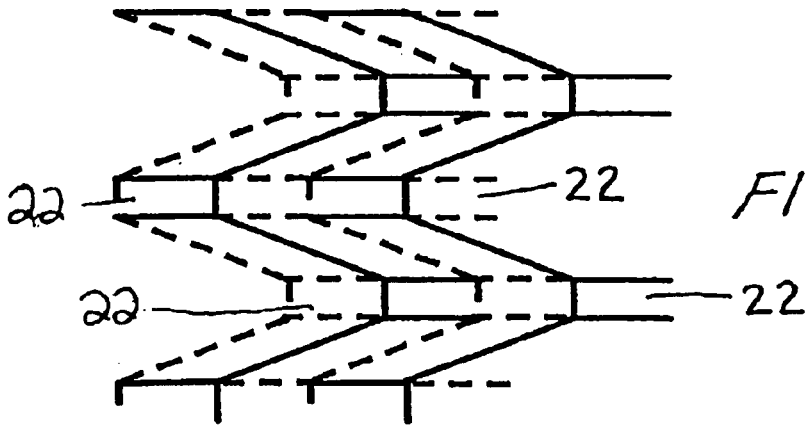

FIG. 15 shows a fold pattern that is based on a simple zig-zag fold pattern with consistent dimensions, i.e. $V_1=V_2=V_{\ldots}=V_n$, and $S_1=S_2=S_{\ldots}=S_n$, and $L_1=L_2=L_{\ldots}=L_n$, but an additional intermediate web 22 is interposed at each longitudinally extending fold peak and each longitudinally extending fold valley.

Figure 16:
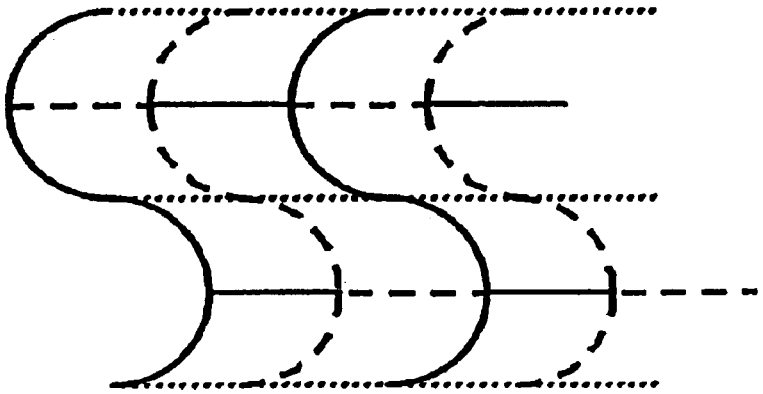

FIG. 16 illustrates a simple counter-directed fold along successive alternating round contours with uniform or consistent dimensions or spacings in the vertical, transverse, and longitudinal directions, namely $V_1=V_2=V_{\ldots}=V_n$, and $S_1=S_2=S_{\ldots}=S_n$, and $L_1=L_2=L_{\ldots}=L_n$. In this context, rather than round curved contours, the curves could follow elliptical, hyperbolic, or essentially any other desired curvature.

Figure 17:
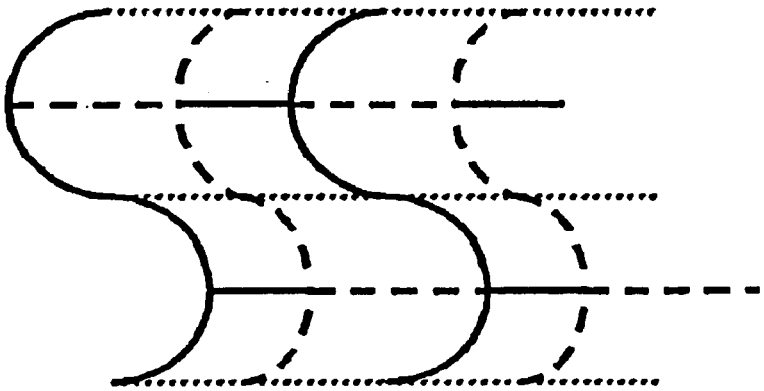

FIG. 17 shows a fold pattern generally similar to that of FIG. 16 with round or curved contours, but in this case having a varying vertical height. Namely, $V_1\neq V_2\neq V_{\ldots}\neq V_n$, while $S_1$32 $S_2=S_{\ldots}=S_n$, and $L_1=L_2=L_{\ldots}=L_n$. Once again, the curves may have a circular, elliptical, hyperbolic, or essentially any other desired curved contour.

Figure 18:
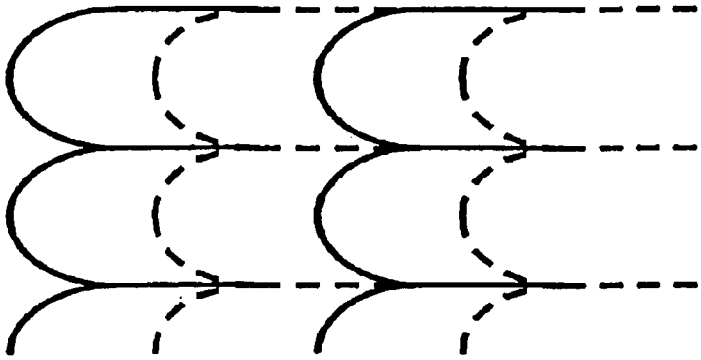

FIG. 18 shows a simple uniformly or consistently directed fold along curved contours, with all of the pertinent dimensions being uniform or consistent, i.e. $V_1=V_2=V_{\ldots}=V_n$, and $S_1=S_2=S_{\ldots}=S_n$, and $L_1=L_2=L_{\ldots}=L_n$. Once again in this case, the curved fold lines can have a circular, elliptical, hyperbolic, or essentially any other desired curved contour.

Figure 19:
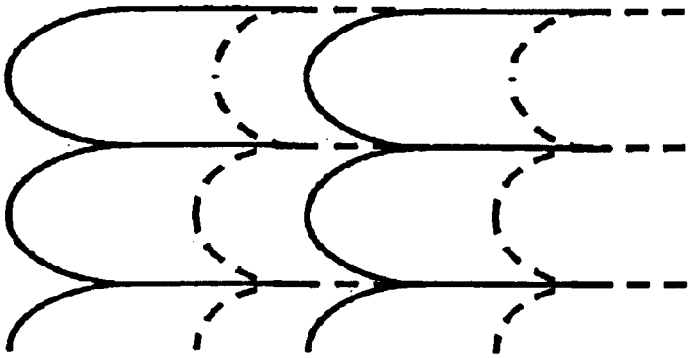

FIG. 19 shows a fold pattern with uniformly or consistently directed curved fold lines, but with variations in the vertical height and in the longitudinal length of successive segments. Namely, $V_1\neq V_2\neq V_{\ldots}\neq V_n$, and $S_1=S_2=S_{\ldots}=S_n$, and $L_1\neq L_2\neq V_{\ldots\neq Ln}$. Once again in this example, the curved fold lines can have a circular, elliptical, hyperbolic, or essentially any other desired curved contour.

Figure 20:
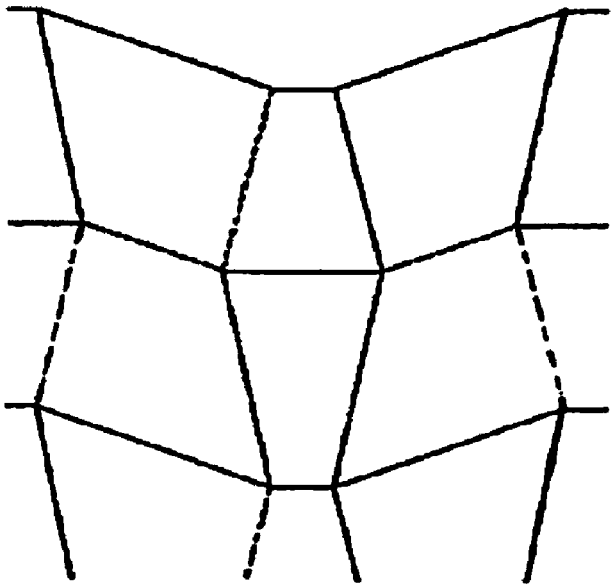
Figure 21:
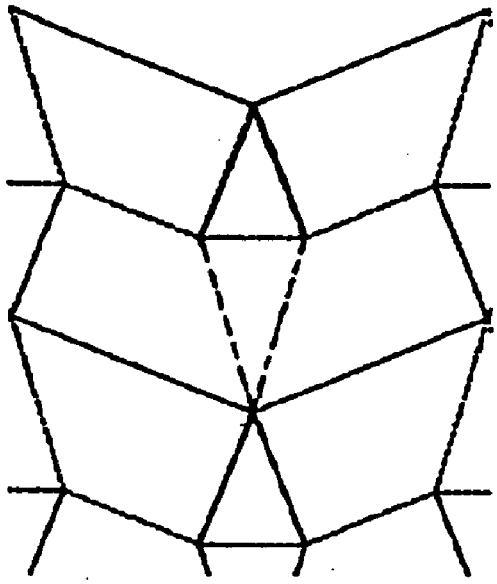

FIGS. 20 and 21 schematically represent examples of folding patterns in which the folds in one direction may be curved or bent in such a manner so that channels are formed in the material web by the folding process, such that these channels remain open in the circumferential direction.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of producing an article comprising a folded core structure, maid method comprising the steps:

a) providing a material web having an initial flat planar configuration;

b) subjecting said material web having said initial flat planar configuration to a continuous pretreatment process comprising forming a repeating pattern of fold lines in said material web from at least one of an upper surface and a lower surface thereof such that said material web with said repeating pattern of fold lines still has said flat planar configuration;

c) after said step b), initiating a formation of folds in said material web along said fold lines on at least one of said upper surface and said lover surface;

d) after said step c), carrying out and completing said formation of said folds along said fold lines to deform said material web from said initial flat planar configuration into a three-dimensionally folded configuration having an increased thickness relative to said flat planar configuration, whereby said initial flat planar configuration of said material web undergoes a longitudinal contraction in a longitudinal direction of said material web, a transverse contraction in a transverse direction of said material web, and a thickness expansion in a direction of said thickness; and e) after said step d), post-treating said material web to stabilize maid folded configuration thereof, to produce therefrom a folded core structure.

2. The method according to claim 1, further comprising, after said step e), a further step of arranging and attaching a respective cover layer on at least one major surface of said folded core structure to produce therefrom a composite structural panel.

3. The method according to clam 1, wherein said step a) comprises providing a web comprising composite reinforcement fibers as said material web.

4. The method according to claim 1, wherein said longitudinal contraction, said transverse contraction and said thickness expansion all occur simultaneously in a single-stage folding process in said step d), and wherein said single-stage folding process is carried out without mechanical guidance of said material web parallel to said fold lines.

5. The method according to claim 1, wherein said transverse contraction and said thickness expansion occur together in a first stage of a folding process in said step d) without said longitudinal contraction, and thereafter said longitudinal contraction occurs in a second stage of said folding process, and further comprising compensating for a travel distance variation of edge portions of said material web relative to a center portion of said material web during said first stage of said folding process.

6. The method according to claim 1, wherein said pre-treatment process comprises at least one of embossing, impressing, creasing, scoring, and perforating said fold lines into said material web.

7. The method according to claim 1, wherein said pre-treatment process further comprises at least one of heating said material web, cooling said material web, etching said material web, applying a binder to said material web, and impregnating a resin into said material web.

8. The method according to claim 1, wherein said post-treating in said step e) comprises at least one of embossing, pressing, creasing, scoring, and perforating said material web.

9. The method according to claim 1, wherein said post-treating in said step e) comprises at least one of heating said material web, cooling said material web, etching said material web, applying a binder to said material web, and impregnating a resin into said material web.

10. The method according to claim 1, wherein said initiating of said formation of maid folds in said step c) comprises directing a flow of a fluid at at least one of said upper surface and said lower surface of said material web.

11. The method according to claim 1, wherein said initiating of said formation of said folds in said step c) comprises mechanically contacting at least one of said upper surface and said lower surface of said material web so as to begin said formation of said folds.

12. The method according to claim 1, wherein said completing of said formation of said folds in said step d) comprises passing said material web between two bristle brush rolls that respectively contact said upper surface and said lover surface of said material web, whereby respective bristles of said two bristle brush rolls intermesh with each other as said material web is deformed and folded along said fold lines between said respective bristles of said two bristle brush rolls.

13. The method according to claim 1, wherein said step b) comprises forming said repeating pattern of fold lines in said material web from both said upper surface and said lower surface.

14. The method according to claim 1, wherein said repeating pattern of fold line comprises respective pluralities of said fold lines intersecting one another in respective star patterns at respective intersections.

15. The method according to claim 1, wherein said repeating pattern of fold lines forms a continuous field of surface areas that are respectively bordered and enclosed by said fold lines and that border one another along said fold lines in said material web.

16. A method of producing a folded structure, comprising the steps:

a) providing a material web having an initial flat planar configuration;

b) forming a repeating pattern of fold lines in said material web by at least one of embossing, impressing, creasing, scoring, and perforating said fold lines into said material web still having said flat planar configuration;

c) initiating a formation of folds in said material web along at least some of said fold lines by directing jets of a fluid at said material web;

d) passing said material web between two intermeshing bristle brush rolls so as to further form said folds in said material web, whereby said initial flat planar configuration of said material web undergoes a longitudinal contraction in a longitudinal direction of said material web, a transverse contraction in a transverse direction of said material web, and a thickness expansion in a direction perpendicular to said longitudinal direction and said transverse direction, from said initiating of said formation of said folds through said further forming of said folds, so as to deform said material web from said initial flat planar configuration to a resulting three-dimensionally folded configuration; and e) stabilizing said three-dimensionally folded configuration by at least one of accentuating, pressing, strengthening, rigidifying, and fixing said folds, so as to form a folded structure of said material web having said three-dimensionally folded configuration.

17. An apparatus for producing a structure comprising a folded core structure fabricated from a planar material web, said apparatus comprising:

a first arrangement for pre-treating the material web from at least one of an upper surface and a lower surface thereof to form fold lines therein while maintaining an initial flat planar configuration of the material web;

a second arrangement for initiating a folding process of forming folds along at least some of the fold lines in the material web;

a third arrangement for proceeding with the folding process and longitudinally retarding the material web, including at least one pair of counter-rotating bristle brush rolls or bristle brush conveyor belts to form a folded structure; and a fourth arrangement for post-treating the material web on the upper surface and the lower surface thereof to stabilize the folded structure.

18. The apparatus according to claim 17, wherein said first arrangement comprises a pair of counter-rotating rolls including at least one roll having a structured surface, a pair of link chains or belts including at least one link chain or belt having a structured surface, or a conveyor belt having a structured surface.

19. The apparatus according to claim 18, further comprising an apparatus for varying a running length between said first arrangement for pre-treating the material web and said second arrangement for initiating the folding process.

20. The apparatus according to claim 17, wherein said third arrangement further comprises an arrangement for contracting a transverse width and expanding a thickness of the material web, including a pair of counter-rotating rolls having a structured surface and an adjustable axis spacing, or a comb-like arrangement with an adjustable gap, as well as an arrangement for compensating a running length of the material web.

21. The apparatus according to claim 20, further comprising a mechanical arrangement or a pneumatic arrangement operating with a fluid pressure for deforming the material web in a direction of the transverse width.

22. The apparatus according to claim 17, wherein said second arrangement comprises a row of movably arranged fluid nozzles.

23. The apparatus according to claim 17, wherein said third arrangement comprises a row of movably arranged fluid nozzles.

24. The apparatus according to claim 17, wherein said fourth arrangement comprises a pair of counter-rotating rolls, conveyor belts, or link chains or belts, having a structured surface including a pattern of edges, and wherein the folded structure has a pattern corresponding to a circumferential development of the pattern of edges of the structured surface of the fourth arrangement.

25. The apparatus according to claim 24, further comprising an arrangement for heating, cooling, coating or impregnating the material web.

26. The apparatus according to claim 17, further a comprising an arrangement for applying at least one additional material web onto the folded structure.

27. The apparatus according to claim 17, further comprising an arrangement for cutting and transporting-away the material web.

28. The apparatus according to claim 17, wherein said first arrangement is adapted to pre-treat the material web from both the upper surface and the lower surface.

* * * * *

UNITED STATES PATENT AND TRADEMARK OFFICE

CERTIFICATE OF CORRECTION

PATENT NO. : 6,913,570 B2
DATED : July 5, 2005
INVENTOR(S) : Kehrle

It is certified that error appears in the above-identified patent and that said Letters Patent is hereby corrected as shown below:

Title page,
Item [30], Foreign Application Priority Data, replace "102 52 941" by -- 102 52 941.8 --.

Column 2,
Line 3, before "material" replace "the," by -- the --.

Column 3,
Line 21, before "process" replace "folding;" by -- folding --.

Column 12,
Line 18, after "$S_1$" replace "32" by -- = --.
Line 31, before ".Once again" replace "$L_1 \neq L_2 \neq V \ldots \neq Ln$" by -- $L_1 \neq L_2 \neq L \ldots \neq L_n$ --.
Line 49, before "method" replace "maid" by -- said --.
Line 62, after "said" replace "lover" by -- lower --.

Column 13,
Line 8, before "folded" replace "maid" by -- said --.
Line 14, after "according to" replace "clam" by -- claim --.
Line 51, before "folds" replace "maid" by -- said --.
Line 63, before "surface" replace "lover" by -- lower --.

Column 14,
Line 6, before "comprises" replace "line" by -- lines --.

Column 16,
Line 12, after "further" delete "a".

Signed and Sealed this

Third Day of January, 2006

JON W. DUDAS
*Director of the United States Patent and Trademark Office*